United States Patent [19]

Jarvis

[11] 4,397,581

[45] Aug. 9, 1983

[54] GROOVER, TROWEL AND BULL FLOAT COMBINATION

[75] Inventor: Jack D. Jarvis, Memphis, Tenn.

[73] Assignee: Aluma form Inc., Memphis, Tenn.

[21] Appl. No.: 174,569

[22] Filed: Aug. 4, 1980

[30] Foreign Application Priority Data

Aug. 10, 1979 [JP] Japan ..... 54-109457[U]

[51] Int. Cl.[3] ..... E01C 19/22

[52] U.S. Cl. ..... 404/97; 15/235.4; 15/235.8; 404/118

[58] Field of Search ..... 404/97, 89, 118; 15/235.4, 235.5, 105.5, 235.6, 235.8, 235.3

[56] References Cited

U.S. PATENT DOCUMENTS

| | | | |
|---|---|---|---|
| 460,644 | 10/1891 | Maurer | 15/235.3 |
| 872,903 | 12/1907 | Connelly | 15/235.8 X |
| 988,457 | 4/1911 | Glasscock | 15/235.8 |
| 1,021,557 | 3/1912 | Runner | 404/97 X |
| 2,278,803 | 4/1942 | Stabbert | 15/235.4 |
| 2,586,472 | 2/1952 | McKnown | 404/97 X |
| 2,617,336 | 11/1952 | Brickler | 404/89 |
| 3,346,905 | 10/1967 | Scarpelli | 15/235.6 |
| 3,729,765 | 5/1973 | Peterson | 15/235.8 |
| 3,798,701 | 3/1974 | Irwin | 15/235.8 |
| 3,806,268 | 4/1974 | Francis | 404/89 |
| 3,936,210 | 2/1976 | Oehlerking | 404/89 |
| 4,155,141 | 5/1979 | Guerra | 15/235.8 |

*Primary Examiner*—Nile C. Byers, Jr.
*Attorney, Agent, or Firm*—Paul M. Denk

[57] ABSTRACT

A combination bull float, hand trowel, groover for use in conjunction therewith, and an elongated handle for attachment with the groover, or the bull float, is provided, with the groover being connectable with either of the bull float or the hand trowel for use in perfecting the finishing of freshly poured concrete. The bull float includes a plate portion having upstanding front and back walls extending upwardly therefrom, with the groover being only slightly longer than the width of the plate portion and incorporating connecting means for fastening it to the bull float, and for providing both a finishing and grooving of the concrete during its working. An elongated handle connects to a bracket upon the bull float, while the groover, if independently used, is also secured through a connector with the elongated handle for facilitating its independent usage for the grooving of finished concrete. The hand trowel is also designed to accommodate the groover, containing a plate member having upturned flanges that cooperate with engaging components of the groover to provide for its removable but secure fixing to the trowel during its usage in both finishing concrete, and providing the necessary expansion groove therein.

12 Claims, 12 Drawing Figures

FIG. 1.
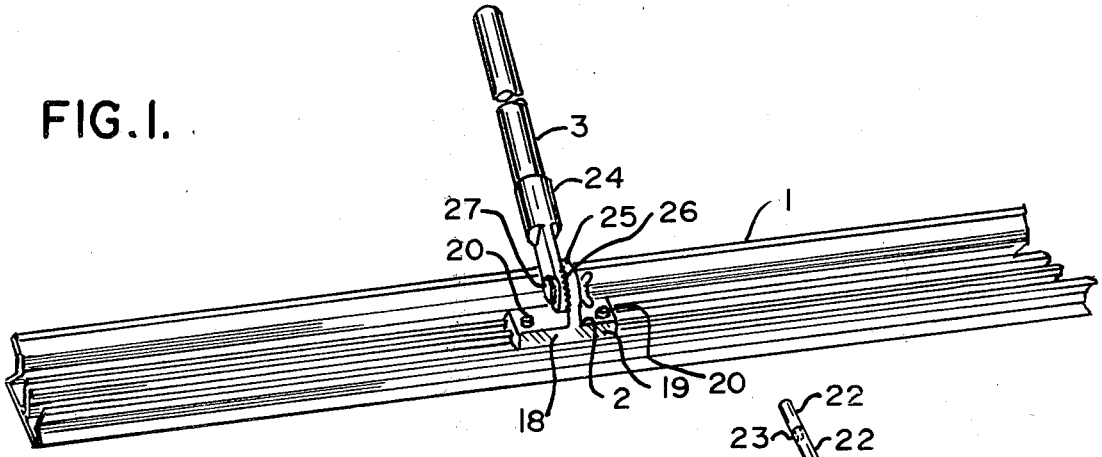
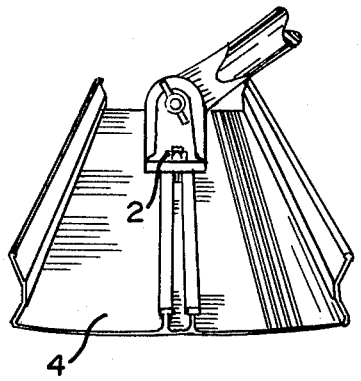
FIG. 2.
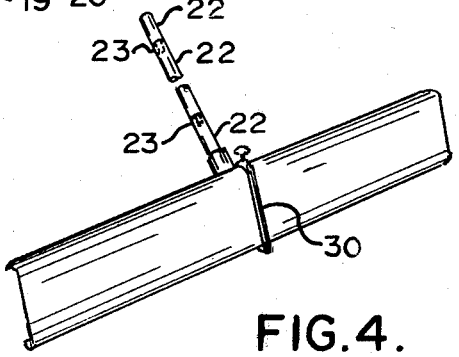
FIG. 4.
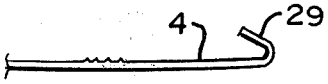
FIG. 5.
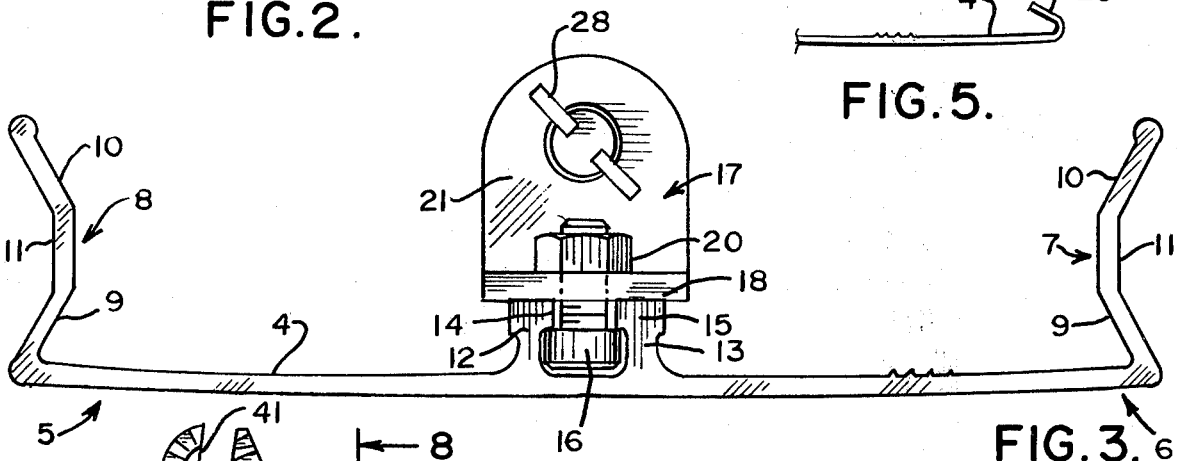
FIG. 3.
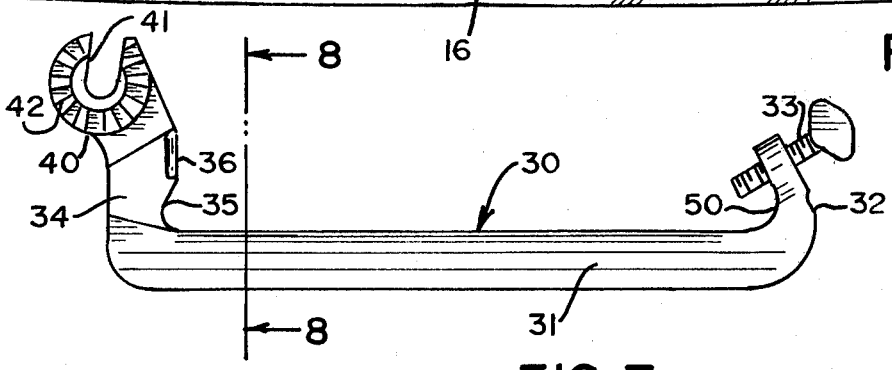
FIG. 7.

GROOVER, TROWEL AND BULL FLOAT COMBINATION

BACKGROUND OF THE INVENTION

This invention relates generally to the combination of an improved bull float, hand trowel, and each capable of usage in conjunction with a removable type groover, thereby providing all of the tools in one package necessary for attaining a finishing of freshly poured concrete.

Numerous styles of concrete floats and other accessories for use in finishing concrete have been available upon the market for some time. In many instances these tools are useful for accomplishing their intended results, but lacking certain refinements that would make them highly efficient in usage for affording frequent consistency in the high quality finishing needed for freshly poured concrete.

The U.S. Pat. No. 3,936,210, to Oehlerking, discloses one such concrete finishing tool, wherein the float member has a handle attached to it, and also provides a removable type accessory for use in furnishing a groove upon the finished concrete surface. While the shown concrete float is apparently effective for its intended purpose, there are a number of drawbacks in its construction that are intended to be remedied by the style of bull float, trowel, and connectable groover present in this current development. For example, the effective usage of the groover accessory of Oehlerking is too elongated in configuration, and therefore, does present some problems in maintaining uniformity in the groove formed over the length of the poured concrete slab. In addition, accumulations of concrete either forwardly or aft of the float member of Oehlerking cannot be effectively moved or shifted to other locations of the forming slab since no structured means are provided for acting as a means for achieving an equilization in the distribution of the poured concrete, and to provide uniformity for the concrete surface. These comments do not report deficiencies of this prior art device, but rather the current invention significantly adds components in its construction so as to provide further utility in its intended functionality to act as a combination tool to furnish complete and uniform finishing to the poured concrete surface.

The U.S. Pat. No. 867,819, to Grundmann, discloses a cement worker's tool, and which may function essentially as a groover, but as can be seen, the groover component is permanently affixed, or integrally formed, in association with the tool plate. This obviously minimizes if not eliminates the use of this tool as a hand trowel for finishing of the poured concrete surface.

A variety of other types of concrete or cement working tools are also shown in the prior art, with the patent to Tullis, U.S. Pat. No. 1,952,398, disclosing a road tool in the nature of a box channel having an elongated handle connected therewith. The U.S. Pat. No. 3,264,668, to Lasker, shows another type of concrete tool, apparently having an elongated handle attached thereto, but this particular tool is primarily used for straightening out of the mesh that is usually provided in concrete structures for reinforcement purposes. U.S. Pat. No. 3,162,881, to Negwer, discloses another form of an adjustable bull float. In the U.S. Pat. No. 3,090,984, to Dunnigan there is disclosed a type of float that is for use essentially for finishing plaster applied to the overhead, as upon the ceiling or along the upper edges of the wall. The U.S. Pat. No. 3,082,460, to Haivala, discloses a concrete working tool, again in the nature of a channel member, having a rather elongated handle fixedly attached thereto. Additionally, the U.S. Pat. No. 1,929,660, to Tullis, discloses another type of tool for use upon road work, mainly being fabricated from a folded sheet metal to function in the nature of a straight edge.

In addition to the Grundmann cement worker's tool, as previously analyzed, a variety of other hand trowel type of instrumentalities have been designed in the prior art. For example, the additional patent to Grundmann, U.S. Pat. No. 1,295,735, discloses another form of a concrete finishing tool having a groover integrally molded upon the tool's body portion. In addition, the U.S. Pat. No. 1,273,060, to Hoff, discloses a concrete edging and marking tool that includes in combination various structural means for adding to the thickness and size in addition to location of the groover formed upon the tool's bottom surface. The Meyers trowel, in U.S. Pat. No. 761,242, discloses a groover or edging means also providing for use in conjunction with the trowel's structure. Various other patents relating to jointing type tools or scrapers are shown in the U.S. Pat. No. 1,664,701, to O'Neal and the U.S. Pat. No. 1,061,085 to Kolson. In addition, the U.S. Pat. No. 853,164, to Courtney, discloses a masonry tool in the nature of a trowel, having what is in the nature of an integral head apparently for acting as a mortar joint forming member.

Various other tools for use in finishing concrete are shown in the U.S. Pat. No. 872,903, to Connelly, which discloses an adjustable type of means for holding a handle to the shown float. The patent to Glasscock, U.S. Pat. No. 988,457, disclosed a float, having an integral groover connected to its lower surface, and having an elongated handle attached therewith. The patent to Pfister, U.S. Pat. No. 4,114,220, discloses a combination leveling and grade checking tool and which may be used for the combined operations of raking, leveling, and settling grade.

The other patents are of interest, one is the U.S. Pat. No. 1,347,938, to Connelly, which discloses a hand tool for use in edging concrete. In addition, the patent to Francis, U.S. Pat. No. 3,806,268, discloses a free hand jointer device, wherein a handle is adjustably connected to the upper surface of the float, and a grooving device may be bolted onto the surface of the plate of the float. It is to be noted that the plate member of the shown Francis float is quite shallow in dimensions, and is different from the construction of that detailed in this current invention.

In view of the foregoing, it is the principal object of this invention to provide a combination bull float, trowel, and groover connectable therewith, and wherein all of these elements may be used as hand tools, or in conjunction with an elongated handle, with various components being interchangeable with other of the instrumentalities above listed, so as to provide means for completely finishing of a concrete surface, in all of its construction aspects, through the usage of the combination of this invention.

Another object of this invention is to provide a bull float having an elongated handle adjustably connectable therewith, wherein the handle may be adjusted at an angle of inclination with respect to the float, so as to provide for finishing either at close range or at some distance from the worker, but in addition, said handle may be shifted longitudinally of the bull float so as to provide finishing around rather confined locations.

Another object of this invention is to provide a cast groover that may be secured directly with the bull float anywhere along its length, but yet be removable therefrom, and at the same and when removed can be reapplied to a hand trowel, or simply have an elongated handle connectable therewith, so as to allow for grooving of the finished concrete hrough a variety of methods.

Another object of this invention is to provide a bull float that incorporates various integrally formed front and back walls that extend upwardly for some heighth, and therein have utility for moving and shifting accumulations of concrete as it is being distributed for leveling and blending into a poured surface.

A further object of this invention is to provide a bull float having rounded, pre-broken-in working surfaces that keep their shape even after heavy usage because of its inherent design advantages attained through the uniform casting of the bull float during its manufacture.

A further object of this invention is to provide a bull float having at least one upstanding front and back wall, or screen walls, which may be used for pushing and pulling of the concrete being spread, and which walls, in addition to a pair of upstanding members proximate the midportion of the float and which function for the location for connection of the handle, also act as means for retention of extra load bearing material, such as weights, that may be applied to the float to enhance its effectiveness during concrete finishing work.

Another object of this invention is to provide a unique groover that can be located anywhere along the length of the bull float, being stably supported by means of upstanding front and back walls.

Yet another object of this invention is to provide a bull float having upstanding walls that may support a plurality of groovers along its length.

Still another object of this invention is to provide a groover that may be used in conjunction with a bull float, and be readily removed therefrom, and can also be attached to a uniquely designed hand trowel where hand finishing and grooving is required to complete the concrete work.

Another object of this invention is to provide an adjustable handle for use in conjunction with a bull float, or independently with a groover, and which handle can be adjusted into various angular directions, and which further may be of telescoping design, or threadily connected together, so that the lengthy handle can be dismantled for storage, or additional length sections added, so as to extend the distance of use of the bull float, or groover, during finishing work.

Still another object of this invention is to provide a combination of tools that complement each other in their usage.

Yet another object of this invention is to provide a combination of tools that may be easily assembled and fabricated as cast components, requiring very few mechanical adjustments in their assembling for ready usage.

These and other objects will become more apparent to those skilled in the art upon reviewing the summary of this invention, and upon undertaking a study of its preferred embodiment in view of the drawings.

SUMMARY OF THE INVENTION

This invention contemplates the cooperative usage of various concrete finishing tools, each which complements the other, for providing the means for finishing of concrete slabs, or the like. The basic aspects of the invention include four components, essentially, an elongated cast bull float, which can be made to almost any length; secondly, a uniquely designed hand trowel; thirdly, a groover instrument that can be used in conjunction with the bull float, or the hand trowel, or even used independently; and finally, an elongated handle for use in conjunction with the bull float, or the groover, and which may be made of various designs so as to provide for its collapsing, as when prepared for storage and nonuse, or which may be lengthened, through the application of additional components, so as to allow the bull float to be used at significant distances.

The bull float, in its construction, is formed preferrably of cast aluminum, having a plate portion of some length, and which length may be varied depending upon the length of bull float desired, particularly since the entire float is constructed of extruded metal. It contains front and back walls which integrally connect proximate the related edges of the said plate member, and which walls serve a plurality of useful functions during the bull float's application. For example, the walls, because of their upstanding sides, have sufficient heighth to function as means for urging and shifting accumulations of concrete around the poured slab, so as to act as a distributor of the concrete during the rough finishing maneuver, while in addition, these walls function as support for the removable groover, or plurality of groovers, when applied to the bull float for obtaining a formation of grooves in the finishing surface. Furthermore, the walls, in conjunction with the integral vertical legs that function as the attachment means for the handle with the bull float, can support a plurality of weights, in a locking fashion, so as to facilitate the addition of weight to the bull float, when such is needed in order to obtain added pressure upon the concrete surface during the performance of a finishing cycle.

The upstanding legs or members that attach to the upper surface of the bull float, and which function as the attachment means for the handle, extend preferably the full length of the said float, meaning that the handle may be shifted off center, as desired, in order that the bull float may be worked around construction obstructions that may be present.

A unique hand trowel is designed and included in this invention, and which also includes a plate member, having a handle braced therewith, with the front of the plate being slightly curved upwardly so as to facilitate the smooth movement of the trowel over the concrete surface being finished.

In addition, a pair of flanges are cut into the plate member, or are welded or otherwise connected to the upper surface of the trowel, and which provide means for bracing the groover thereto when it is applied to the hand trowel in preparation for forming a groove along the concrete surface.

The groover is also preferably formed of a cast material, having a length only slightly greater than the width of the formed bull float, or the hand trowel, so that it may be quickly and expeditiously interchanged between both of said components during usage in performing concrete finishing work. The groover is formed as a blade member, of the length previously identified, and having a double concave curvature provided on each of its sides, and converging into a lower edge, so as to form the type of smoothly appearing groove in the concrete surface that can serve its primary function as means where any cracking of the concrete may occur during any contraction or expansion, but at the same time, providing suc a groove that is of enhanced appearance that it does not detract from the esthetics of the professionally finished surface. The groover has upturned edges at both its front and back portions, with the upturned edge at the front portion having an aperture provided therethrough, being threaded, and through which a fastener may insert for use in firmly attaching the groover to either the bull float or the type of hand trowel previously described. The back upturned edge of the groover is formed having a formed support that is useful for biasing against the wall of the bull float, or a flange of the hand trowel, to add support to the securement of the groover with such of these tools, with said upturned edge also extending further higher, and having a connector integrally formed thereof, and which is useful for having attached thereto the handle of this invention. The connector of the groover is formed having a series of ribs radially disposed around a slot formed therethrough, with the bottom of the handle also being formed having a boss-like member, complementary of the groover connector, with said boss having a series of ribs formed around it, and which are disposed for alignment and intermeshing with the ribs of the connector so that the handle will firmly secure with the groover when a fastener is tightened between these two components.

BRIEF DESCRIPTION OF THE DRAWINGS

In the drawings,

FIG. 1 discloses an isometric view of the bull float having its handle attached therewith;

FIG. 2 provides a perspective side view of the bull float and a partial handle as shown in FIG. 1;

FIG. 3 affords an isometric underside view of the bull float and its handle, showing the handle being formed of interconnecting section, and with the groover of this invention attached to the underside of the said bull float;

FIG. 4 is an isometric view of the underside of the bull float also showing the groover attached thereto;

FIG. 5 discloses a fragmentary view of the back edge of the bull float showing a modification thereto wherein the said back edge is formed integrally as a curl or bend;

FIG. 7 discloses a side view of the groover of this invention;

DESCRIPTION OF THE PREFERRED EMBODIMENT

Figure 8:
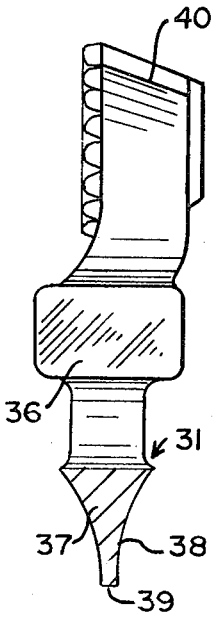
FIG. 8 discloses a back view of the groover shown in FIG. 7.

In the drawings, and in particular referring to FIG. 1, the bull float 1 is shown in its full length, having an attachment means 2 connecting to its approximately centrally thereof, and which attachment means is furnished for securement with the handle 3 useful for allowing the worker to utilize the bull float at substantial reach. In referring to FIGS. 2 and 3, it can be seen that the bull float comprises a plate portion 4, which has a width extending approximately equidistant to either side of the attachment means 2, and which plate may be formed flat, but preferably, as shown in FIG. 3, is slightly convex particularly proximate its end edges, as at 5 and 6, so as to prevent the development of any vacuum or suction which otherwise makes the float difficult of handling particularly when gliding over the soft concrete in preparation for its finishing. Connecting integrally to both the front and back edges of the plate portion 5 are the front and back walls 7 and 8, respectively, and which walls have substantial heighth, and thereby can function as means for pushing accumulations of concrete to other locations upon the slab being poured. These walls are somewhat concaved in appearance, but generally each is constructed having inclined parts 9 and 10, with intermediate flattened surfaces 11. Thus, these parts and the surface 11 are provided for aiding in the shifting of concrete about the slab, but in addition, the flat surfaces 11 are useful also for providing means for attachment of the groover, as to be hereinafter described, with the bull float in preparation for forming narrow channels along the upper surface of the concrete slab for purposes as previously analyzed.

It can be seen, particularly from FIGS. 1 and 2, that these front and back walls for the float extend substantially the full length of the member, which facilitates the construction of this component, initially, from a metal casting process, which means that it can be formed preferably from aluminum, magnesium, steel, or other castable metals or materials.

Arranged integrally extending upwardly from the approximate central upper surface of the portion 4 and forming part of the attachment means of this invention are a pair of upstanding members or legs 12 and 13, and which are formed having slightly inwardly extending shoulders as at 14 and 15, respectively, which are designed for embracing the head 16 of a removable fastener that attaches with a bracket 17. The bracket is formed as an angular like member that incorporates a series of flanges, such as a pair of such flanges 18 and 19 that extend to either side of an upstanding flange 20. The fasteners 16, there being two in number as shown, as in FIG. 1, have their enlarged heads embraced within the shoulders 14 and 15 of the attachment means, with the threaded portion of said fasteners extended upwardly through a pair of apertures provided through the flanges 18 and 19, and disposed for accommodating nuts 20 that may be tightened upon the fasteners, firmly against the surface of the flanges 18 and 19, for locking the handle 3 of this invention to its bull float 1. As can be seen, since these legs 12 and 13 also extend the full length of the bull float, the fasteners 16 may be loosened, allowing for the attachment means 20 to be slid laterally, to either side of the bull float, in the event that it is necessary that an off-center setting of the handle must be made in order that the bull float may be worked around particular obstructions that may exist upon the concrete slab being finished.

It is contemplated that an elongated handle 3, as previously designated, will be used in conjunction with this bull float, in addition to the groover, and this handle may be designed into sections, as shown at 22, being separate along the locations 23. These sections for the handle may be telescoping, one within the other, or they may simply have threaded ends, as shown, to provide for their being threadedly connected together. In the latter method, such may be more desirable, because then additional sections may be threaded together so as to provide the bull float with a handle of some significant length and to furnish its accessibility to a long range location, depending upon the size of the slab being poured.

The handle is included having a connecting sleeve, as at 24, which is enlarged into a boss-like member 25, and having a series of ribs, or being serrated, as shown at 26, for intermeshing with similar type ribs or serrations provided upon the surface of the bracket 21. An aperture provided through both this boss and the connector of the bracket is designed for accommodating a fastener 27, having a wing nut 28 provided on one side, so that the handle may be rigidly fastened to the bracket 21 so that adjusted angle and elevation to which it has been set.

As can be also seen in FIG. 5, the back edge 5 of the bull float may be formed not having the upstanding wall 8, as shown, but rather, it may be curled, or otherwise bent, as shown at 29, with the upstanding wall only being provided at the front edge 7 of the said float. In this manner, the front wall 7 may still be used for pushing accumulations of concrete, and suffice for that purpose, but with the back wall not being used for any similar operation since the front wall can be used for all such shifting of concrete needed for smoothing out the surface of the poured slab.

As can be seen in FIG. 4, a groover 30 is provided connecting with the bull float, and may be used for forming a channel-like formation along the length of the slab as is normally customarily applied to a surface of finished concrete of any significant dimensions. In referring to FIG. 7, the groover 30 incorporates a blade like member 31, with a length slightly greater than the width of the bull float, and which incorporates at its front end an upturned edge, as at 32, and which bends slightly rearwardly, having a threaded aperture therethrough and through which a fastener 33 may be turned for use in the fastening of this groover to the bull float, or other tools. The back edge 34 of the groover is also integrally turned upward, and provides sufficient clearance, as at 35, to allow for the entrance and clearance of the lower proximate edge of the bull float, but is also formed upwardly thereof having a support like member 36 that biases against the flat wall member 11 of the bull float in order to firmly secure the groover against the same. This urging of the support surface 36 against the flat wall 11 significantly occurs as the fastener at 33 is tightened against the inclined surface 9 provided at the opposite wall 7 of the said bull float. It can be seen that the support surface 36 is of significant width to provide for stabilization in the mounting of the groover upon the said bull float (See also FIG. 8).

The blade 31 of the groover is formed of a pair of concaved surfaces 37 and 38, and which converge downwardly towards the lower edge 39 of the formed groover. In this manner the blade of the groover can provide a rather smoothly contoured groove or channel upon the concrete surface over which it glides.

Figure 9:
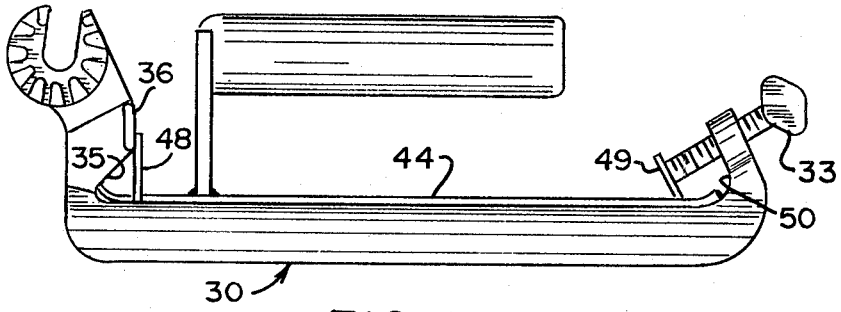
FIG. 9 provides a side view of the hand trowel having the groover connected therewith.
Figure 12:
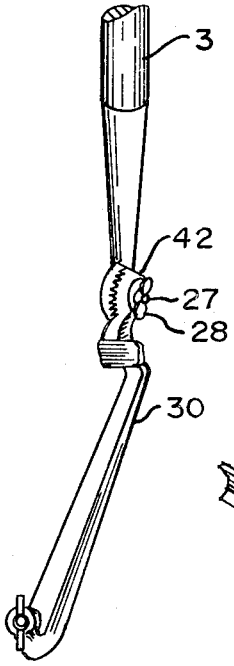
FIG. 12 discloses the groover of this invention having the handle attached therewith for independent usage.

Extending further upwardly from the upturned edge 34 of the groover is an integral connector, as at 40, having a cut-out slot 41 provided therethrough, and surrounding the slot are a series of ribs or serrations 42 that can cooperate with the similar type ribs 25 provided at the lower end of the handle 3 to attain an interlocking of the handle with the groover when it is desired to use the groover independently as shown in the manner as displayed in FIG. 12, or as also shown in FIG. 9. Once again, the fastener 27, having the wing nut 28, are useful for holding these two components together into their usable configuration. And, as previously explained, upon a loosening of the fastener 27, the handle may be readjusted to any angular disposition with respect to its groover 30, with the fastener then being relocked in position to allow for firm and continued usage of the groover during the finishing of concrete.

Figure 10:
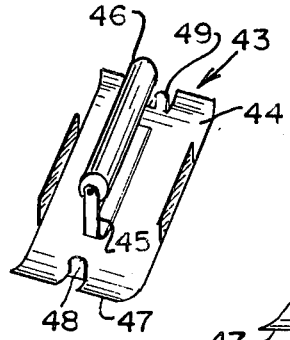
FIG. 10 discloses an isometric view of the top of the hand trowel.

A hand trowel is also provided within the design of this combination invention, and being of a particular configuration, so that it can be used independently, or in conjunction with the removable groover, as previously analyzed. While referring to FIGS. 9 through 11, the hand trowel 43 incorporates a plate member 44, having a brace 45 securing a handle 46 thereto, in the event that the hand trowel is used just for that purpose, as a hand finishing tool. But should the hand trowel be used in conjunction with the groover 30, as shown in FIG. 9, then the frontal edge of the trowel, which incidentally is curved, as shown at 47, has a bent-up flange 48, in addition to a similar type of flange 49 provided at its back edge, with the flange 48 designed for being encountered by the formed support 36 of the groover, as previously explained. In addition, the flange 49 is disposed for having the groover fastener 33 being tightened against it, so as to provide for a snug and firm fitting of the groover upon the hand trowel. As shown, the clearance portion 35 of the groover is also useful for providing clearance for the front curved edge 47 of the said trowel, while a similar type clearance at 50 is provided at the opposite upturned edge of the groover for allowing space for disposition of the other edge of the said plate member 44 of the hand trowel.

Figure 11:
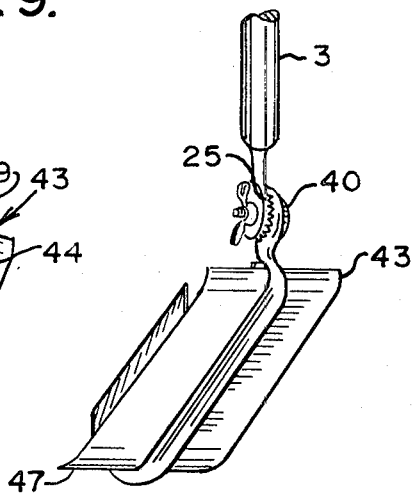
FIG. 11 discloses an isometric view of the hand trowel with the groover attached thereto and with a part of the handle being attached to its groover.

As can be seen in FIG. 11, the handle 3 may once again connect through its member 25 with the connector portion 40 of the groover even with the hand trowel 43 secured therewith, so as to provide a smaller form of float for providing grooving with lateral smoothness to the concrete being finished.

Figure 6:
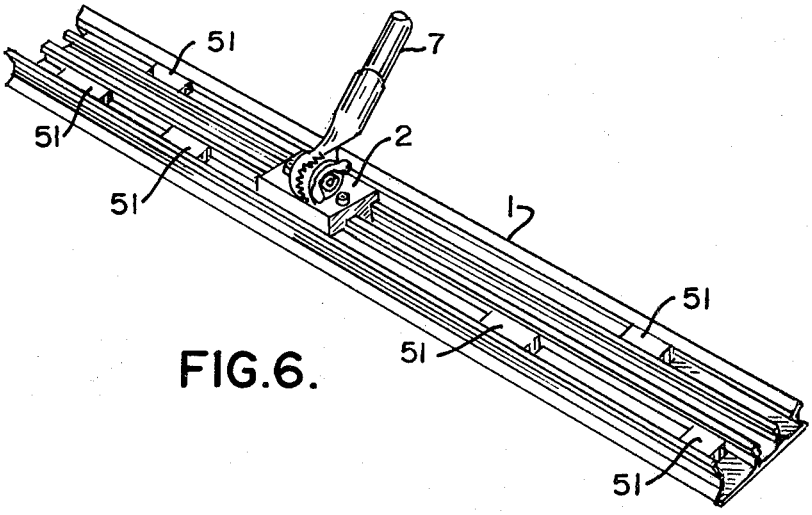
FIG. 6 discloses a view similar to that shown in FIG. 1, wherein the bull float has a series of weights applied to it to enhance its weight during a finishing function.

Finally, as can be seen in FIG. 6, the bull float 1, as previously analyzed, having the handle 3 connecting through the attachment means 2 may incorporate a series of weights, as at 51, so that in the event the bull float is constructed of, as previously explained, aluminum or magnesium, and therefore, of light weight metal, the addition of weights may be desirable for enhancing the weight of the float during its usage for a finishing operation. As can be seen, and particularly through FIG. 3, the weights may simply slide intermediate the incline surfaces 9 of the front and back walls 7 and 8, and between their respective upturned legs 12 and 13, and reasonably held wedged into position during repeated and continuing usage of the said bull float. In addition, this Figure shows the handle through its attachment means being somewhat offset laterally in a manner as previously reviewed.

Various modifications or changes in the structure of this invention, or the combination of the various shown components, may occur to those skilled in the art upon reviewing the subject matter of this invention. Any such variations, if within the scope of this invention, are intended to be encompassed within the claims to any patent protection issuing hereon. The description of the preferred embodiment given herein is set forth for illustrative purposes only, and is not meant to be construed for limiting the scope of this invention.

Having thus described the invention what is claimed and desired to be secured by Letters Patent is:

1. A bull float for use in finishing concrete or the like, comprising, a plate portion having a handle removably attached thereto, said plate portion having at least a front edge, said plate portion having a substantially upstanding front wall integral of its front edge, said front wall being contoured to function as means for moving accumulations of concrete for attachment of other working instrumentalities to the float, said substantially upstanding front wall formed in a concavely-like manner to facilitate the moving of accumulations of concrete and for providing attachment of other working instrumentalities ot the said bull float, attachment means for the handle formed along the upper side of the plate portion and extending for some length longitudinally thereof to allow for adjustment for the positioning of the handle upon the said plate portion, said attachment means including a pair of upstanding members, each member having an inward shoulder projecting towards each other and thereby forming a clearance slot between the said members, at least one fastener having an enlarged head being accommodated within said slot, a bracket connecting at the lower end of the handle and securing with the said fastener for holding the handle and the plate portion of the bull float together in their adjusted positioning, said bracket including at least one angle member, one flange of the angle member having an aperture therethrough for accommodating the said fastener, the other angle flange having a series of ribs formed thereon, the lower end of the handle forming a boss, said boss having a series of formed ribs thereon, the ribs of the angle capable of intermeshing with the boss ribs for interlocking the bracket and its accompanying handle into a fixed position, and a fastener holding said boss and bracket into their locked positioning.

2. The invention of claim 1 and wherein said fastener is removable for providing angular readjustment between the handle with respect to the plate portion of the bull float.

3. The invention of claim 2 and wherein there being an aperture provided through the said other angle flange and also through the handle formed boss for accommodating the locking fastener therethrough.

4. A groover instrument for use in providing a groove in fresh concrete, comprising, a blade member of some length, said blade having a double concaved curvature on each of its sides and converging into a lower edge, said blade at its back edge forming an integral upturned portion, said upturned portion extending further upwardly and having a connector formed thereon, said connector capable of securing with handle means of a length to allow usage of the groover by worker while in a standing position, and said blade at its front edge also having an upturned portion and for assuring unobstruction with the concrete during its usage.

5. The invention of claim 4 and wherein said connector has a series of ribs formed thereon, the lower end of the handle including a boss-like portion, said boss having a series of formed ribs thereon, said ribs of the connector capable of intermeshing with the boss ribs for holding the groover and its accompanying handle into a fixed position and a fastener holding said boss and connector into their locked position.

6. The invention of claim 5 and wherein said fastener is removable for providing for readjustment of the handle with respect to the groover to which it connects.

7. The invention of claim 6 and wherein there being an aperture provided through the connector and an alignable aperture provided through the handle boss for accommodating the locking of the fastener therethrough.

8. A bull float for use in finishing concrete or the like, comprising, a plate portion having a handle removably attached thereto, said plate portion having at least a front edge, said plate portion having a substantially upstanding wall integral of its front edge, said front wall being contoured to function as means for moving accumulations of concrete and for attachment of other working instrumentalities to the float, said substantially upstanding front wall formed in a concavely-like manner, attachment means for the handle formed along the upper side of the plate portion and extending for some length longitudinally thereof to allow for adjustment in the positioning of the handle upon the said plate portion, said plate portion having a back edge, a substantially upstanding back wall integral of said back edge and also being contoured to function as means for moving accumulations of concrete and for attachment of other working instrumentalities to the float, said substantially upstanding back wall being formed in a concavely-like manner, a blade member having a length only slightly greater than the width of the said plate portion, said blade having double concaved curvature on each of its sides and converging into a lower edge, said blade at its back edge forming an integral upturned portion, said portion having a formed support for biasing against the contoured back wall of the bull float, and the blade at its front edge also having an upturned portion and cooperating with fastener means for firmly securing the groover to the said bull float during usage.

9. The invention of claim 8 and including an integral connector extending upwardly from the upturned back edge of the groover, said connector provided for connecting with the float handle.

10. A hand trowel for use in finishing concrete, comprising, a plate member, a brace extending upwardly from said plate member, and having a handle connected thereto and being disposed in a disposition convenient for holding by the worker during finishing of concrete, said plate having a slight curve at its frontal edge for facilitating the smooth movement of the trowel over the concrete surface being finished, a groover removably attachable to the underside of said trowel, said groover incorporating a blade having a length only slightly greater than the length of the trowel plate member, said blade having a double concave curvature on each of its sides and converging into a lower edge, said blade at its back forming an integral upturned portion, said portion having a formed support for biasing against the trowel, the blade at its front also having an upturned portion and cooperating with fastening means for further securing the groover with the said hand trowel, said plate member at its frontal edge having an upturned flange, said flange being disposed for encountering with the formed support provided at the front edge of the said blade, and said plate having another upturned flange provided at its back edge and being disposed for connecting with the fastener means firmly securing the groover with the hand trowel, said upturned back portion of the groover extending further upwardly and having a connector formed thereon, an elongated handle rod provided for the hand trowel, said handle rod having a boss formed at its lower end, said handle boss and the groover connector capable of being held together in a fixed position, a fastener holding said members in their locked position, whereby the hand trowel may also be used by the concrete finisher while disposed in a standing position.

11. A bull float for use in finishing concrete or the like, comprising, a plate portion having a handle removably attached thereto, said plate portion having a front edge, said plate portion having a back edge, said plate portion having a substantially upstanding front wall integral of its front edge, said plate portion having a substantially upstanding back wall integral of its back edge, both said front wall and back wall being contoured to function as means for moving accumulations of concrete and for attachment of other working instrumentalities to the floats, both said substantially upstanding front wall and back wall being formed in a concavely-like manner, attachment means for the handle formed along the upper side of the plate portion and extending for some length longitudinally thereof to allow for adjustment of the positioning of the handle upon the said plate portion, each of said substantially upstanding front and back wall being formed having at least one inclined part and a flattened surface integral therewith, said attachment means including a pair of upstanding members, each member having an inward shoulder projecting towards each other and thereby forming a clearance slot between the said members, at least one fastener having an enlarged head being accommodated within said slot, a bracket connecting at the lower end of the handle and securing with the fastener for holding the handle and the plate portion of the bull float together in their adjusted positioning, said bracket including at least one angled member, one flange of the angle member having an aperture therethrough for accommodating the said fastener, the angle flange having a series of ribs formed thereon, the lower end of the handle forming a boss, said boss having a series of formed ribs thereon, the ribs of the angle capable of intermeshing with the boss ribs for interlocking the bracket and its accompanying handle into a fixed position, and a fastener holding said boss and bracket into their locked position.

12. The invention of claim 11 and wherein said bull float handle includes a series of handle sections threadedly connected together.

* * * * *